US011034420B2

(12) United States Patent
Hoffmann

(10) Patent No.: US 11,034,420 B2
(45) Date of Patent: Jun. 15, 2021

(54) RESCUE LADDER ATTACHMENT

(71) Applicant: Ross Hoffmann, Prospect, KY (US)

(72) Inventor: Ross Hoffmann, Prospect, KY (US)

( * ) Notice: Subject to any disclaimer, the term of this patent is extended or adjusted under 35 U.S.C. 154(b) by 249 days.

(21) Appl. No.: 16/275,196

(22) Filed: Feb. 13, 2019

(65) Prior Publication Data

US 2020/0255107 A1 Aug. 13, 2020

(51) Int. Cl.

| | |
|---|---|
| ***B63C 9/32*** | (2006.01) |
| ***E06C 7/06*** | (2006.01) |
| ***E06C 7/02*** | (2006.01) |
| ***E06C 1/10*** | (2006.01) |

(52) U.S. Cl.

CPC ..... *B63C 9/32* (2013.01); *E06C 1/10* (2013.01); *E06C 7/02* (2013.01); *E06C 7/06* (2013.01)

(58) Field of Classification Search

CPC ..... E06C 1/08; E06C 1/10; E06C 7/02; E06C 7/04; E06C 7/06; E06C 7/08; B63C 9/32

See application file for complete search history.

(56) References Cited

U.S. PATENT DOCUMENTS

| | | | | | |
|---|---|---|---|---|---|
| 457,805 | A | | 8/1891 | Whittington | |
| 679,385 | A | | 7/1901 | Klemme et al. | |
| 836,785 | A | * | 11/1906 | Shumaker | E06C 1/345 182/103 |
| 1,018,877 | A | | 2/1912 | Chickering | |
| 1,030,905 | A | | 7/1912 | Howard | |
| 1,036,932 | A | * | 8/1912 | Thompson | E06C 1/10 182/178.2 |
| 1,059,340 | A | | 4/1913 | Boyer | |
| 1,113,836 | A | * | 10/1914 | Russell | E06C 7/06 182/210 |
| 1,170,395 | A | * | 2/1916 | Beatty | E06C 7/06 182/210 |
| 1,180,408 | A | * | 4/1916 | Miller | E06C 7/06 182/210 |
| 1,210,827 | A | * | 1/1917 | Myers | E06C 7/06 182/210 |
| 1,244,645 | A | * | 10/1917 | Schreiner | E06C 7/06 182/210 |
| 1,393,048 | A | | 10/1921 | Stiles | |
| 1,445,848 | A | | 2/1923 | Henry | |
| 1,555,344 | A | * | 9/1925 | Whitney | E06C 1/32 182/22 |
| 1,695,428 | A | | 12/1928 | Johnson | |
| 1,942,210 | A | | 1/1934 | Harting | |
| 1,950,574 | A | * | 3/1934 | Smith | E06C 1/12 182/210 |
| 2,024,039 | A | | 12/1935 | Harting | |
| 2,388,415 | A | | 11/1945 | John | |
| 2,632,592 | A | | 3/1953 | Eisman | |
| 2,680,555 | A | | 6/1954 | Ragnar | |
| 2,760,706 | A | | 8/1956 | Pearl | |
| 2,781,158 | A | * | 2/1957 | Raitt | E06C 1/345 182/163 |
| 2,797,038 | A | | 6/1957 | Etienne | |
| 2,895,660 | A | * | 7/1959 | O'Keefe | E06C 1/12 182/210 |

(Continued)

*Primary Examiner* — Alvin C Chin-Shue
*Assistant Examiner* — Shiref M Mekhaeil
(74) *Attorney, Agent, or Firm* — Middleton Reutlinger

(57) ABSTRACT

An attachment for a ladder includes a pair of spaced rails secured together by at least one rung and a removable pin at an end for securing the attachment to a standard ladder.

4 Claims, 5 Drawing Sheets

(56) References Cited

U.S. PATENT DOCUMENTS 3,105,667 A 10/1963 Bauer
3,223,369 A 12/1965 Benninger
3,365,023 A * 1/1968 Nagle ..... E06C 1/12 182/211
3,502,173 A * 3/1970 Arnold ..... E06C 1/12 182/46
3,556,253 A 1/1971 Hyman
3,565,211 A 2/1971 Blanc
3,768,594 A 10/1973 Kramer
3,941,341 A 3/1976 Brogdon
4,017,047 A 4/1977 Brogdon et al.
4,036,325 A * 7/1977 Ruff ..... E06C 7/08 182/46
4,047,257 A 9/1977 Bondarchuk, Sr.
4,086,980 A * 5/1978 Shortes ..... E06C 1/10 182/151
4,179,011 A * 12/1979 Morawski ..... E06C 7/488 182/206
4,182,431 A 1/1980 Wing
4,266,631 A 5/1981 Larson et al.
4,299,306 A 11/1981 Hawkins
4,311,207 A * 1/1982 Lurry ..... E06C 1/345 182/107
4,364,451 A 12/1982 Wright
4,458,783 A * 7/1984 Stakes ..... E06C 7/488 182/107
4,519,477 A * 5/1985 Ralston ..... E06C 7/423 182/107
4,787,478 A * 11/1988 Stakes, Jr. ..... E06C 1/345 182/107
4,923,049 A * 5/1990 Kent ..... E06C 1/38 182/107
4,938,312 A * 7/1990 Trail ..... E06C 1/345 182/206
5,054,581 A 10/1991 Henson
5,165,501 A * 11/1992 Donahey ..... E06C 7/42 182/107
5,205,603 A 4/1993 Burdette, Jr.
5,358,071 A * 10/1994 Stennett ..... E04D 13/12 182/107
5,429,207 A 7/1995 Frank et al.
5,590,739 A * 1/1997 High ..... E06C 1/12 182/169
5,775,460 A 7/1998 Stone
6,044,930 A 4/2000 Haymn
6,058,875 A 5/2000 Krish, Jr.
6,190,222 B1 2/2001 Senger
6,378,654 B1 4/2002 Ziaylek, Jr. et al.
6,575,268 B2 * 6/2003 Carder ..... E04G 1/30 182/118
6,681,893 B1 * 1/2004 Coulson ..... E04D 15/00 182/107
6,866,117 B2 3/2005 Moss
7,165,649 B2 1/2007 Latimer et al.
7,424,933 B2 9/2008 Weiss
8,857,568 B2 * 10/2014 Foster, Sr. ..... E06C 1/10 182/45
9,010,491 B2 * 4/2015 Trang ..... E06C 7/46 182/129
9,187,954 B1 * 11/2015 Parsons ..... E06C 7/48
2002/0007981 A1 1/2002 Stoneburg
2002/0079166 A1 6/2002 Gaik
2002/0112919 A1 8/2002 Graham, Jr.
2004/0011590 A1 1/2004 Quick
2004/0045770 A1 3/2004 Duan
2004/0129497 A1 7/2004 Weiss
2005/0029042 A1 2/2005 Latimer et al.
2005/0284698 A1 * 12/2005 Allen ..... E04D 15/00 182/82
2006/0054399 A1 * 3/2006 Dudschus ..... E06C 1/36 182/214
2007/0075199 A1 4/2007 Stewart et al.
2008/0202850 A1 * 8/2008 Anderson ..... E06C 7/182 182/106
2009/0200113 A1 8/2009 Weiss
2010/0219017 A1 9/2010 Inman
2011/0011678 A1 1/2011 Sheffield
2011/0164399 A1 7/2011 Driver et al.
2013/0037351 A1 * 2/2013 Gallup ..... E06C 1/32 182/129
2013/0112501 A1 5/2013 Gealy et al.
2014/0110839 A1 4/2014 Lin
2014/0322863 A1 10/2014 Lin
2014/0367194 A1 12/2014 Bolinski et al.
2015/0204140 A1 7/2015 Umlor et al.
2015/0325547 A1 11/2015 Lin
2017/0141067 A1 5/2017 Lin
2017/0254145 A1 9/2017 Ballard et al.
2017/0321413 A1 11/2017 Pridham
2018/0094485 A1 4/2018 Carrera
2018/0363373 A1 * 12/2018 Anderson ..... E06C 7/488
2019/0136622 A1 5/2019 Levy
2020/0040656 A1 * 2/2020 Mora ..... E06C 1/12

* cited by examiner

RESCUE LADDER ATTACHMENT

BACKGROUND OF THE INVENTION

Field of the Invention

The present invention relates generally to an apparatus for converting a conventional ladder into an emergency rescue ladder. The apparatus described is a removable ladder attachment that secures quickly to a conventional ladder and provides a hinged extension that may be positioned in a break or hole in a semi-frozen body of water to aid in rescue operations.

Description of the Related Art

In rescue events where a person or animal has fallen through the ice surface of a semi-frozen body of water it is often impossible for a rescuer to place much weight on the unstable ice surface, thus making it difficult to reach a person who has fallen through the ice. Obviously, time is of the essence in in these situations, since hypothermia and the attendant loss of motor and cognitive function set in quickly as body temperature plummets.

Various devices have been developed and used to assist in ice-breakthrough rescues, including various rope devices and ladders. The use of a rescue ladder offers some advantages, since the ladder provides a pair of opposed side rails that distribute weight across a width of the ice surface and can easily be slid towards the ice break from a distance. Once the ladder has been extended to the break area, the person being rescued need only hold on to a ladder rung and the rescuers can then pull the ladder back towards a more stable section of ice, or the shoreline.

The use of a conventional ladder in ice rescues does suffer from several disadvantages however. In some instances the person being rescued may not be capable of holding onto a ladder rung tightly enough to be pulled out of the water as the ladder is retracted by rescuers. Furthermore, in some instances it is desirable to be able to lower a portion of the ladder into the hole caused by the break in the ice, so that a victim can place his or her feet on a rung and thus be pulled out of the water to safety. However, with conventional ladders that simply lay flat on the ice surface this is impossible.

Accordingly, there is a need in the art for an apparatus to be used in conjunction with a ladder to assist in ice-breakthrough rescue operations that is quick to assemble, readily deployed, and capable of being lowered or placed at least partially in the water to enable a victim to grasp the rescue apparatus.

SUMMARY OF THE INVENTION

The present disclosure is related to an apparatus for providing a ladder attachment that converts a conventional ladder to a rescue ladder. The system described herein provides a ladder attachment that is wider than the width of the ladder to which it is attached. The ladder attachment may include a pair of spaced apart side rails that are secured together by at least one rung.

In various embodiments, the system disclosed herein provides an attachment that includes at least one end having a removable rung or pin that slides through two opposed apertures in the side rails of the attachment. This removable rung acts as a hinge when the attachment is secured to a conventional ladder by aligning the opposed apertures with the end rung of a conventional ladder and then inserting the removable pin through the cylindrical rung. This feature of the system enables a rescuer or rescue team to rapidly deploy the ladder attachment, quickly securing it to a longer ladder for emergency use.

In some embodiments and aspects both ends of the attachment may include a removable pin. In these embodiments the attachment may be used to secure two ladders together as needed. In other aspects and embodiments one end of the attachment may include a step or foothold to assist a person being rescued whereby the step end of the attachment may be placed in the water.

In various implementations set forth, a removable ladder attachment for use with a ladder of predetermined size having at least one hollow rung is described. The removable ladder attachment may have a first and a second side rail having a plurality of rungs extending between the first and the second side rail, wherein the plurality of rungs separate the first and the second side rail by a first predetermined width. The removable latter may also have a first aperture formed in the first side rail and a second aperture formed in the second side rail substantially opposing the first aperture. The removable ladder may also include a removable rung insertable through the first aperture and the second aperture and extending between the first side rail and the second side rail wherein a first end of the removable rung is extends beyond the first rail and a second end of the removable run extends beyond the second rail. In some implementations, the first predetermined width of the removable ladder attachment is greater than a second predetermined width of the ladder of predetermined size having at least one hollow rung to which the removable ladder is to be pivotally attached. In further implementations, the removable rung is sized to extend through the at least one hollow rung of the ladder of predetermined size and through the first and the second aperture of the removable ladder and be releasably locked in place.

The term "ladder" as used herein includes any type of ladder having a rung or rungs that are cylindrically and hollow so that the removable rung or pin of the attachment may be positioned there through.

It should be appreciated that all combinations of the foregoing concepts and additional concepts discussed in greater detail below (provided such concepts are not mutually inconsistent) are part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

Other features, objects and advantages of the present invention will become apparent from the detailed description of the drawing Figures taken in conjunction with the appended drawing Figures.

BRIEF DESCRIPTION OF THE DRAWING FIGURES

In the drawings, like reference characters generally refer to the same parts throughout the different views. The drawings are not necessarily to scale. Emphasis is instead generally placed upon illustrating the principles of the disclosure, wherein.

DETAILED DESCRIPTION OF THE PREFERRED EMBODIMENT(S)

Figure 1:
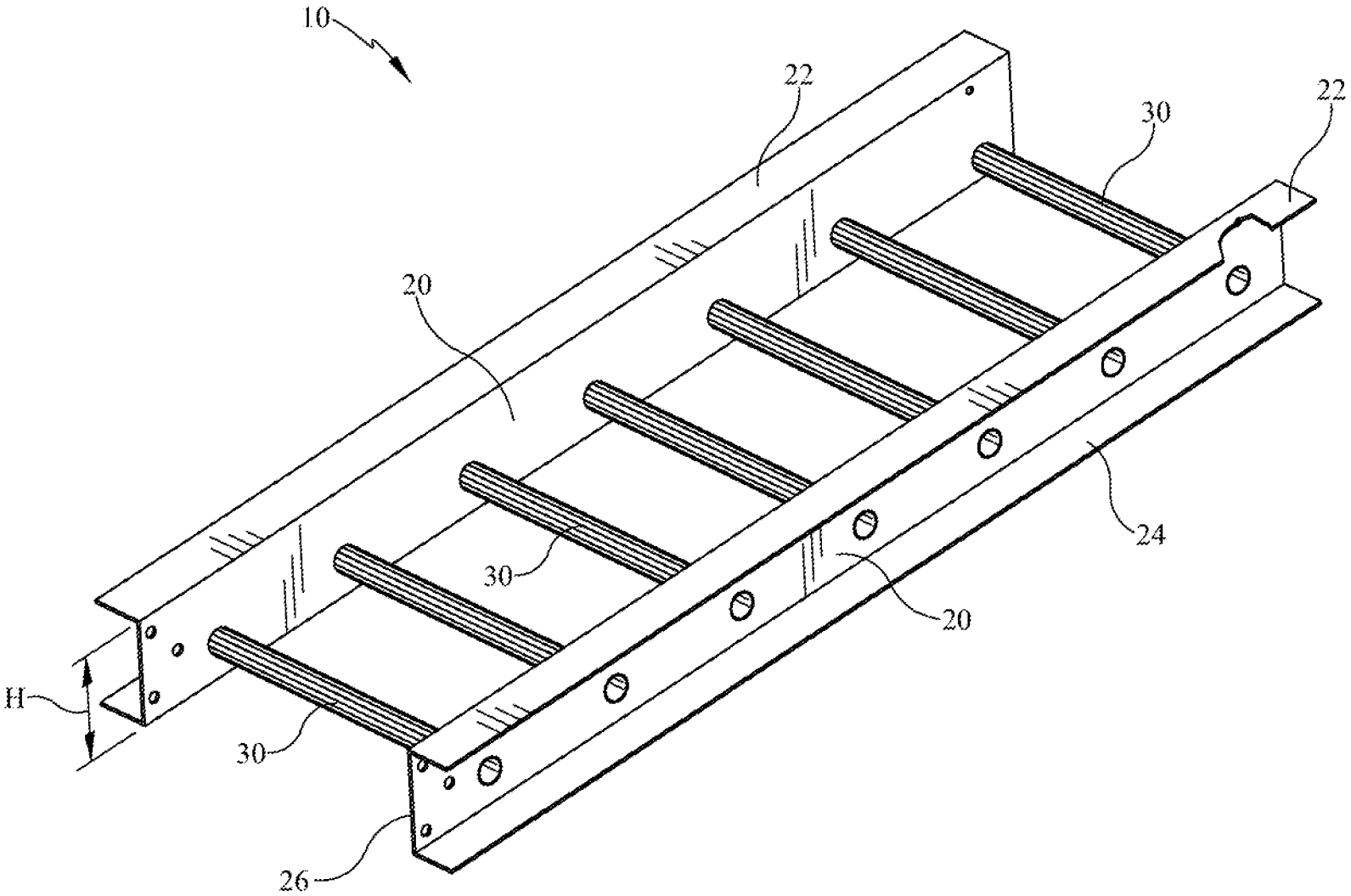
FIG. 1 is a perspective view of a ladder attachment in accordance with one embodiment of the present invention.
Figure 2:
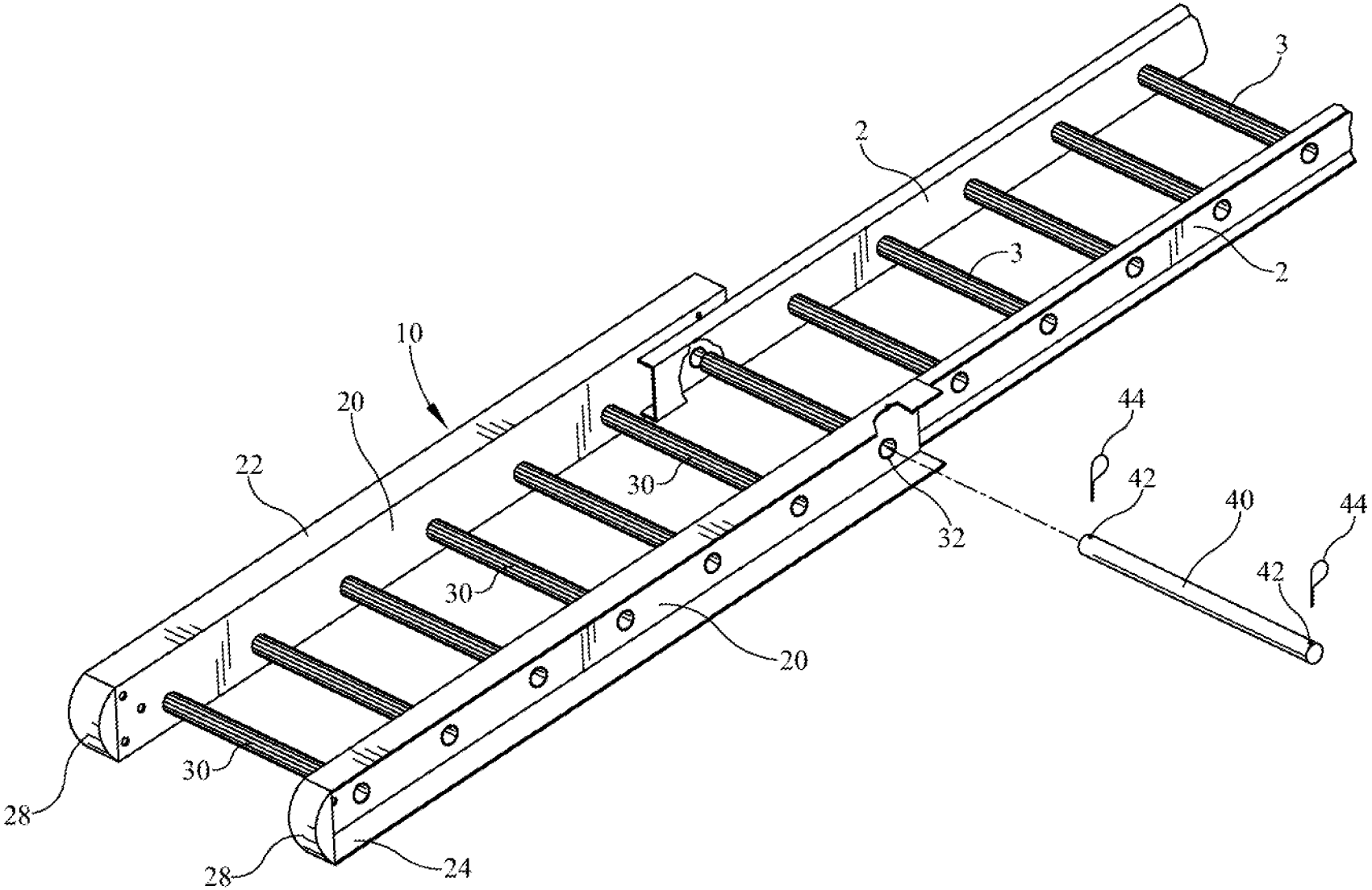
FIG. 2 is a perspective view of a ladder attachment being secured to a standard ladder in accordance with one embodiment of the present invention.
Figure 3:
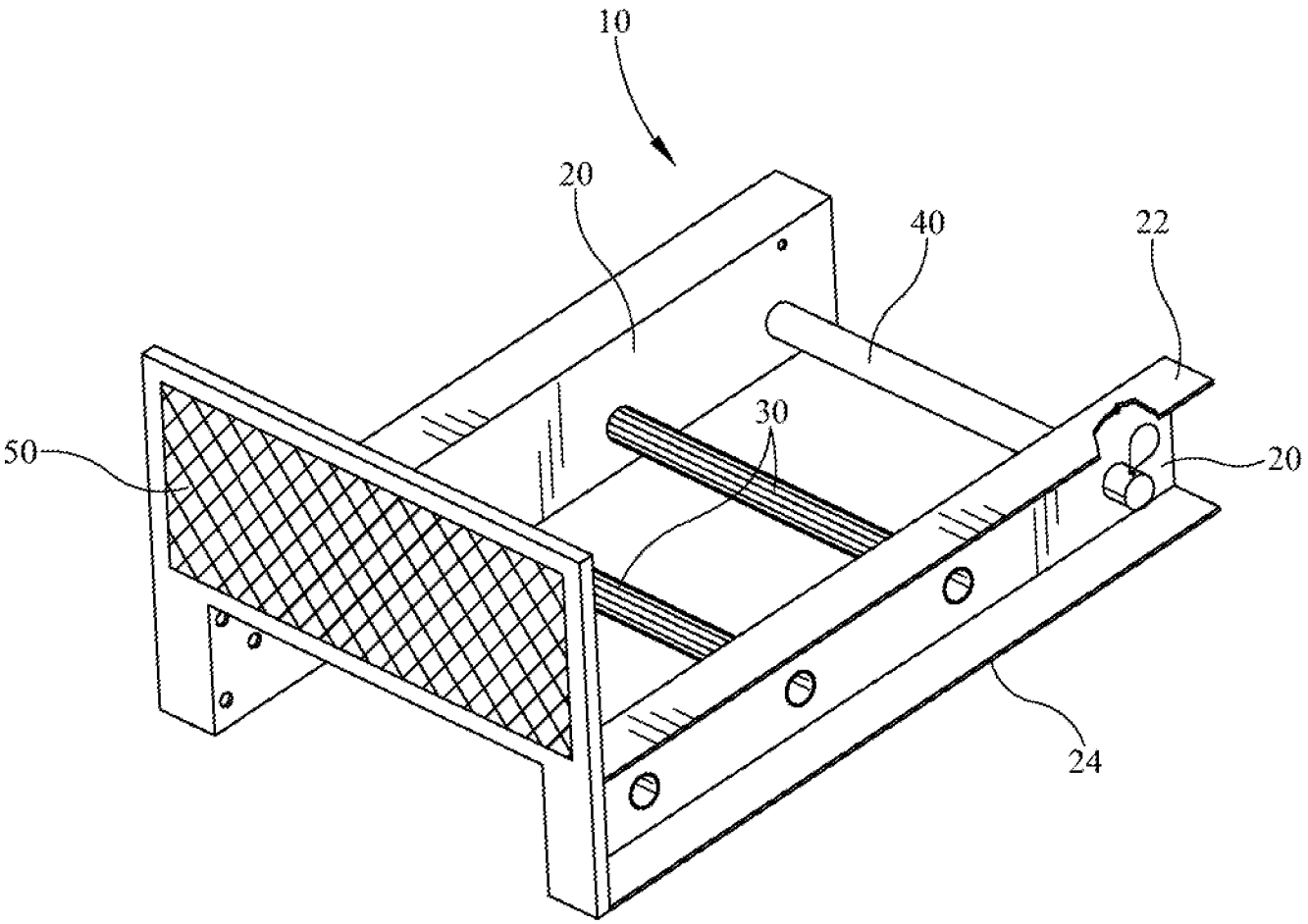
FIG. 3 is a perspective view of a ladder attachment in accordance with one embodiment of the present invention.

Referring now to drawing FIGS. 1 and 2, and in accordance with various embodiments of the invention, the system described herein overcomes the aforementioned difficulties in the prior art by providing a ladder attachment apparatus 10 for facilitating ice-breakthrough rescue. In various aspects of the invention, the attachment apparatus 10 is constructed to be used in conjunction with a conventional ladder 1 of predetermined size. Ladder 1 may include a pair of spaced side rails 2 separated by a plurality of rungs 3. In various aspects ladder 1 rungs 3 are typically shaped as hollow cylinders, whereby a pin or rod may be inserted into and through rungs 3, as will be discussed further herein below.

In some embodiments ladder 1 is constructed to have a conventional spacing between rails 2, for example 12 or 16 inches, although one of ordinary skill will understand that a wide variety of ladder 1 rail 2 spacings are capable of being employed in conjunction with attachment apparatus 10 without departing from the scope of the invention. Furthermore a ladder or ladders 1 used in conjunction with apparatus 10 may have any length and still be capable of being utilized with apparatus 10. It should be noted that commercial emergency and residential use ladders are typically manufactured in compliance with safety and sizing standards set by the Occupational Safety and Health Administration (OSHA) as well as the American Ladder Institute (ALI). The invention disclosed herein is, in some embodiments, intended to be operable with a many of the ladders 1 manufactured according to these standards.

In various embodiments attachment apparatus 10 is constructed of a pair of spaced, generally parallel side rails 20 secured together by at least one rung 30. Side rails 20 may be constructed to have top 22 and bottom 24 flanges that extend outwardly away from rails 20, thereby providing a surface along which attachment 10 may slide during use. Top and bottom flanges 22, 24 may be produced in a variety of widths. For example, in some embodiments a three inch wide top and bottom flange 22, 24 may be employed to facilitate sliding across ice 5 and further to increase the surface area over which weight is distributed when a person being rescued is being pulled to safety, thereby reducing the possibility of additional breakthroughs.

In some exemplary embodiments top flange 22 and bottom flange 24 may terminate at either end 26 of attachment 10 in a curved or chamfered edge 28, thereby enabling attachment 10 to slide or glide along an ice 5 surface without digging in or causing undue resistance. Furthermore, spaced side rails 20 are spaced apart to be slightly wider than the ladder 1 to which attachment 10 is being secured, so that side rails 20 can be positioned outside the rails of a conventional ladder 1, as will be discussed further herein below.

Figure 5:
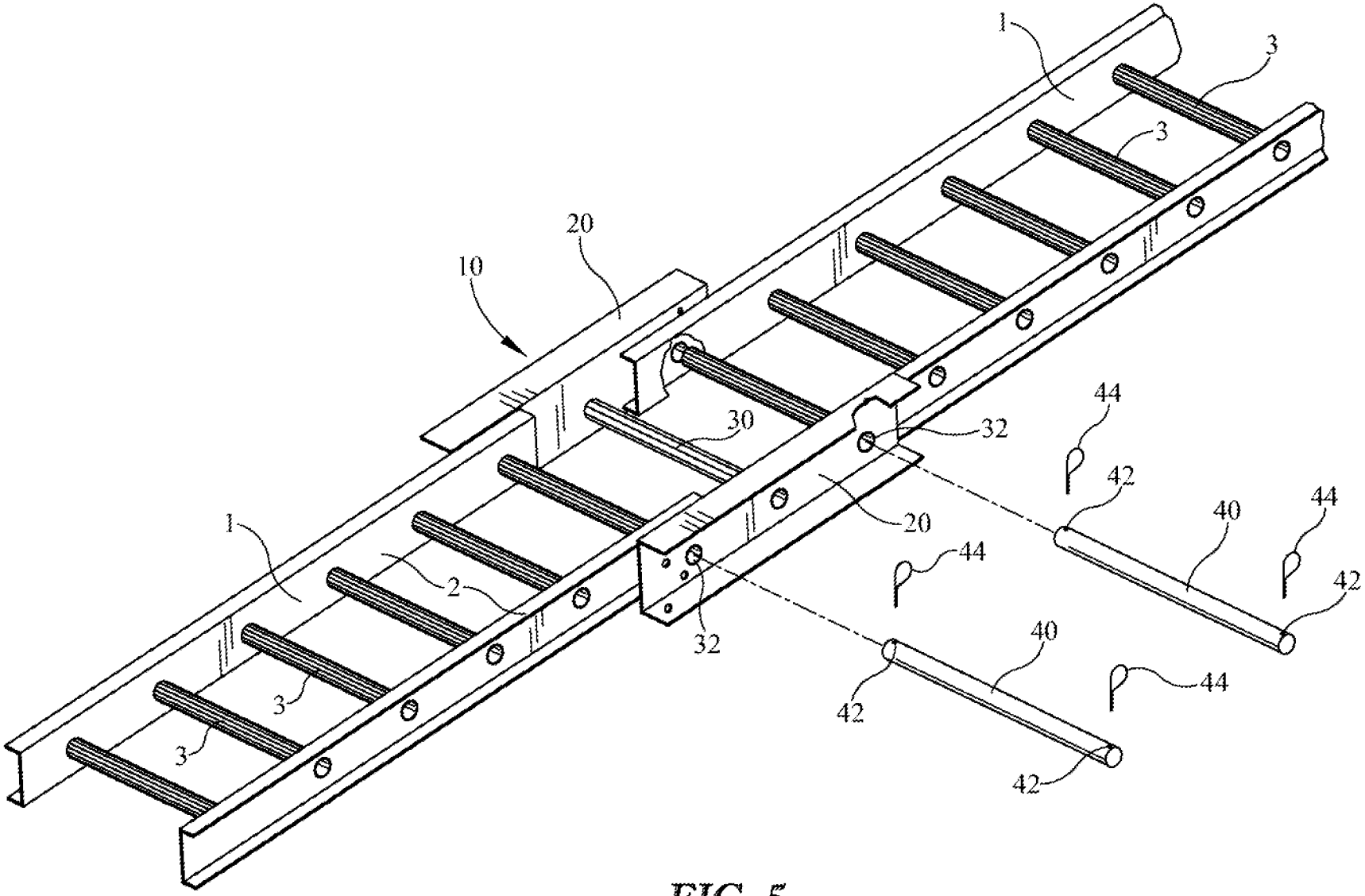
FIG. 5 is a perspective view of a ladder attachment being used to join two standard ladders in accordance with one embodiment of the present invention.

In some embodiments depicted in FIGS. 1, 2 and 5, ladder attachment 10 includes a removable rung or pin 40, or alternatively a pair of removable pins 44 at either end, one at each end of attachment 10. Removable pin 40 may include an aperture 42 at each end thereof, to accept a cotter pin 44 or similar fastener. Side rails 20 of attachment 10 may include at least one pair of opposed apertures 32 through which removable pin 40 may be inserted. When ladder attachment 10 is not in use, removable pin 44 is simply inserted through apertures 32 and secured in place with a removable pin 44 or similar fastener. Removably fastening rung or pin 40 into the apertures of the ladder attachment 10 may be accomplished through other fastening structures instead of a cotter pin 44. For example, spring loaded depression buttons may be formed in the rung 40 in place of the apertures 42 which would lock the rung/pin 40 in position at either end. Other types of fasteners may be utilized to allow the rung 40 to be removed from an attached configuration affixing the ladder attachment 10 to the ladder 1 and within rung 3.

As best seen in FIG. 5 the removable attachment 10 may be removably secured to ladder 1 by removing pins 44 from the rung/pin 40 of the attachment 10, positioning side rails 20 of attachment outside an end rung 3 of ladder 1, aligning apertures 32 with the end rung 3 and then sliding removable pin 40 through the hollow end rung 3. Once through, removable pin 40 can be removably secured by inserting a cotter pin 44 through the apertures 42 and either end thereof. In some embodiments removable pin 40 may be replaced with a collapsible cylindrical rung 40 that is capable of sliding through apertures 32.

Figure 4:
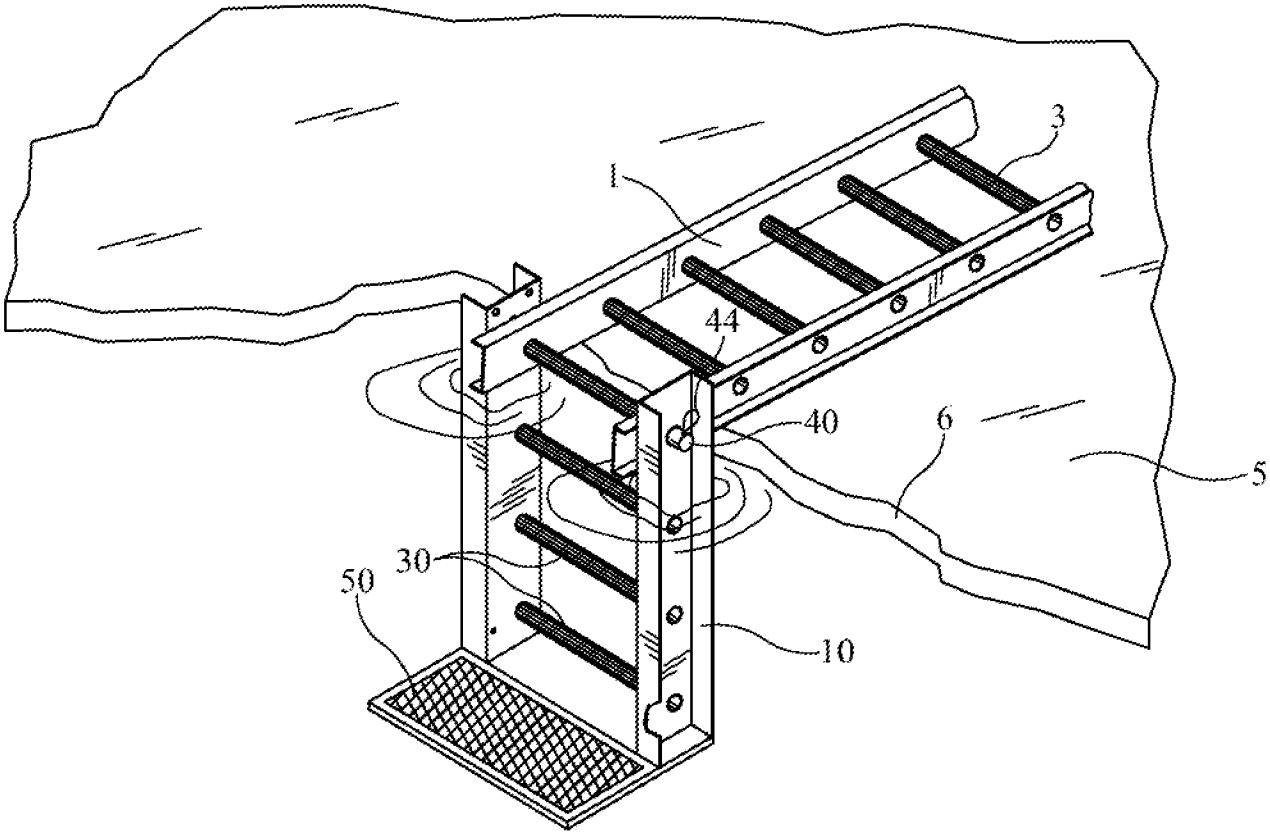
FIG. 4 is a partial perspective view of a ladder attachment and ladder being used in a rescue operation in accordance with one embodiment of the present invention.

Once secured as described herein above and as depicted in FIG. 4, ladder attachment 10 is capable of being positioned in a break or hole 6 in an ice surface 5 by simply sliding ladder 1 toward the hole 6, and then letting attachment 10 slide into the hole 6. Since attachment 10 is secured to ladder 1 by a pin 40 through the hollow ladder rung 3, attachment 10 is free to pivot around the central axis of pin 40, thereby allowing attachment 10 to slide down into hole 6 to be grasped or stood on by a person being rescued. In some embodiments, where attachment 10 is constructed to be relatively short from end to end, it may be easily lowered into even a small hole 6 or break in the ice 5. In a yet further embodiment in of the invention, one end of attachment 10 may be provided with a step 50 that extends outwardly to facilitate standing by a person being rescued. Step 50 may be constructed as a grate or other non-slip surface to enhance traction. In these embodiments the step 50 is positioned away from the ladder 1 to which attachment 10 is being secured so that it enters the hole 6 first when attachment is properly positioned.

In some aspects and embodiments of the invention, and as best depicted in FIG. 5, ladder attachment 10 may include two removable pins 40, one at each end thereof, positioned in two pairs of opposed apertures 32 respectively. In these embodiments, attachment 10 may be used to quickly secure two ladders 1 together where a longer length is need to reach someone in a rescue situation. Each pin 40 is inserted through an end rung 3 of one of the ladders 1 and then secured in place, thereby providing a rescuer a very quick and simple system for securing two ladders together. Furthermore, in some embodiments, attachment 10 may include a removable pin 40 at each end and just a single rung 30, thereby providing a compact and easy to store ladder attachment 10 for ice rescues. This embodiment of the invention is advantageous since the space needed to store the attachment 10 is minimal and can be accommodated by most fire trucks and emergency response vehicles.

It should be noted that ladder attachment apparatus 10 may be constructed of any conventional material that is commonly used for a conventional ladder, such as fiberglass, aluminum, steel, or even wood without departing from the scope of the invention. Furthermore, attachment 10 may be constructed in a wide variety of sizes. Spaced rails 20 need only be slightly wider than the ladder 1 to which the attachment is being secured. Additionally, attachment 10 may include a plurality of rungs 30, or just one rung 30 depending on the space and storage needs of the user.

While the present invention has been shown and described herein in what are considered to be the preferred embodiments thereof, illustrating the results and advantages over the prior art obtained through the present invention, the invention is not limited to those specific embodiments. Thus, the forms of the invention shown and described herein are to be taken as illustrative only and other embodiments may be selected without departing from the scope of the present invention, as set forth in the claims appended hereto.

I claim:

1. A removable ladder attachment for use with first and second ladders each having a pair of side rails spaced a predetermined width size and having at least one hollow rung comprising:

a pair of spaced side rails connected by at least one rung, said spaced side rails having first and second ends and a pair of opposed apertures in the first end thereof;

a first removable rung sized to be inserted through said opposed apertures and said hollow rung of said first ladder; and a second pair of opposed apertures in the second end of said spaced side rails, and a second removable rung sized to be inserted through said second pair of opposed apertures and said hollow rung of said second ladder, whereby said attachment is secured to both a first and a second ladder.

2. The removable ladder attachment as claimed in claim 1 comprising:

a plurality of rungs secured between said spaced side rails and top and bottom flanges extending outwardly from said spaced side rails.

3. The removable ladder attachment as claimed in claim 1 comprising:

a curved edge on each end of said spaced side rails.

4. The removable ladder attachment as claimed in claim 1 wherein said spaced side rails are spaced wider than the predetermined width of said first and second ladder side rails.

* * * * *